United States Patent [19]

Fischer

[11] Patent Number: 4,895,544

[45] Date of Patent: Jan. 23, 1990

[54] TOY CONSTRUCTION KIT

[75] Inventor: Artur Fischer, Waldachtal/Tumlingen, Fed. Rep. of Germany

[73] Assignee: fischerwerke Artur Fischer GmbH & Co., KG., Waldachtal/Tumlingen, Fed. Rep. of Germany

[21] Appl. No.: 300,060

[22] Filed: Jan. 23, 1989

[30] Foreign Application Priority Data

Feb. 1, 1988 [DE] Fed. Rep. of Germany ..... 3802858

[51] Int. Cl.[4] ..... A63H 33/12

[52] U.S. Cl. ..... 446/122; 446/124

[58] Field of Search ..... 446/124, 122, 123, 113, 446/111, 85, 120, 121, 105, 107; D21/108

[56] References Cited

U.S. PATENT DOCUMENTS

| | | | |
|---|---|---|---|
| 2,907,137 | 10/1959 | Ehrmann | 446/127 |
| 3,811,219 | 5/1974 | Fischer | 446/127 X |
| 4,171,590 | 10/1979 | Fischer | 446/122 |

FOREIGN PATENT DOCUMENTS

| | | | |
|---|---|---|---|
| 923959 | 7/1947 | France . | |
| 83927 | 8/1971 | German Democratic Rep. . | |
| 572143 | 1/1958 | Italy | 446/113 |
| 621486 | 2/1981 | Switzerland . | |
| 794289 | 4/1958 | United Kingdom . | |

*Primary Examiner*—Mickey Yu

*Attorney, Agent, or Firm*—Michael J. Striker

[57] ABSTRACT

A toy construction kit has an angled profiled member with two arms arranged at a an angle relative to one another and each provided with a plurality of apertures for engaging with the locking pegs of adjoining components, a substantially block-shaped adapter arranged inside the angled profiled member between the arms and fixable to the angled profiled member, the adapter having free external sides provided with connecting elements for connecting further components thereto, and elements for fixing the adapter to the angled profiled member and including a locking peg engages through a respective one of the apertures of the angled profiled member.

8 Claims, 1 Drawing Sheet

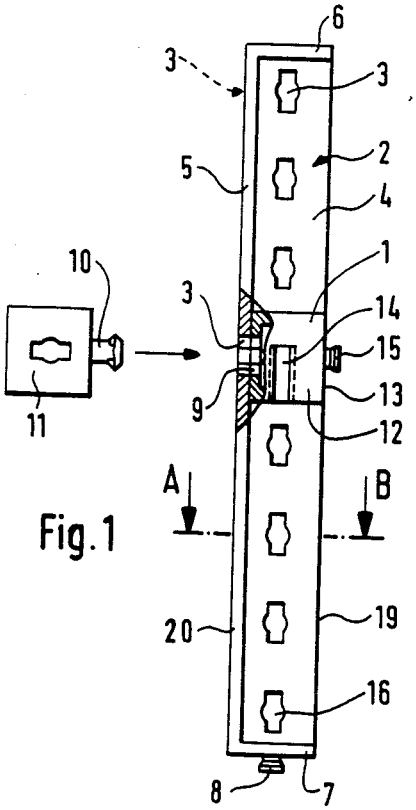
Fig. 1
Fig. 3
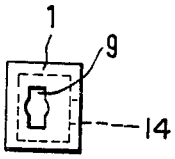
Fig. 4
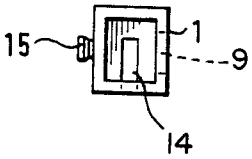
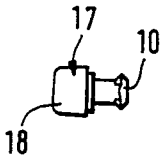
Fig. 5
Fig. 2
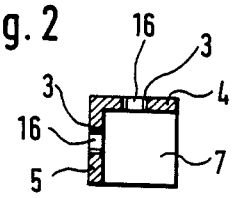

TOY CONSTRUCTION KIT

BACKGROUND OF THE INVENTION

The present invention relates to a toy construction kit with an angled connection for struts formed as angled profiled members.

Struts which are formed as angled profiled members are known in the art. The lateral faces which form the arms of the angled profiled member are provided with a plurality of apertures. The locking pegs of an adjoining component or an adjoining strut extending at right angles can be inserted and locked in the apertures. The angled profiled members have only two lateral faces, and therefore it is not easily possible to attach adjoining construction elements on all their sides. More particularly, no additional angled profiled members with end face attachment areas can be attached in a star-shaped configuration to an angled profiled member with the use of the conventional connecting elements.

SUMMARY OF THE INVENTION

Accordingly, it is an object of the present invention to provide a toy construction kit which eliminates the above mentioned disadvantages.

More particularly, it is an object of the present invention to provide a toy construction kit with such angled profiled members which enables components projecting at right angles to be attached in a star-shaped configuration to the angled profiled member.

In keeping with these objects and with others which will become apparent hereinafter, one feature of the present invention resides, briefly stated, in a toy construction kit in which a block-shaped adapter is placed against inner faces of an angled profield member and fixed by means of a locking peg which engages through an aperture of the angled profiled member, the free edges of the adapter are in alignment with the longitudinal edges of the arms of the angled profiled member, and the external side of the adapter are provided with connecting elements, such as apertures, pegs, slots and the like.

The adapter which can be block-shaped or cube-shaped is secured to the inner faces of the angled profiled member by means of the above mentioned locking peg. The free external sides of the adapter are used as connecting faces which are in alignment with the longitudinal edges of the arms of the angled profiled members. Thereby a total of four structural components projecting at right angles relative to one another can be attached to the free external side of the adapter and to the two adjoining lateral faces of the angled profiled member.

The free external sides of the adapter can be provided for example with a undercut slot and a tapering peg serving as connecting elements.

Another feature of the present invention is that an additional component can have an end face provided with the above mentioned locking peg for fixing the adapter. The locking peg can engage in the adapter through an aperture in the angled profiled member and through a corresponding aperture in the adapter.

For manufacturing reasons, the adapter can be open on its one side. This side in assembled condition is covered by the lateral face of the angled profiled member. A locking peg of a further component to be fastened to the angled profiled member can be inserted in the aperture of the angled profiled member facing the open side of the adapter.

All angularly connected parts of the inventive construction kit are preferably composed of high quality plastic material. The angled profiled members as well as the adapters open on one side are easy to manufacture. As compared with the manufacture of solid profiled members, the consumption of the material for the parts of the inventive construction kit is lower and the tools required are simpler. Nevertheless the adapter provides the attachment to all sides of the angled profiled members in the same way as in the case of solid profiled members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a toy construction kit in accordance with the present invention, including an angled profiled member, an adapter and an adjoining component which fixed the adapter to the angled profiled member;

FIG. 2 is a view showing a cross-section of the construction kit along the line A-B of FIG. 1;

FIG. 3 is a view showing a lateral face of the adapter of FIG. 1, facing the component to be fastened;

FIG. 4 shows an open underside of the adapter of FIG. 1; and

FIG. 5 is a view showing a locking peg for fixing the adapter on the angled profiled member.

DESCRIPTION OF THE PREFERRED EMBODIMENTS

A toy construction kit in accordance with the present invention has an adapter which is identified with reference numeral 1 and is parallelepiped-shaped or block-shaped. The construction kit further includes an angled profiled member 2 having two arms 4 and 5. The arms of the angled profiled member 2 are provided with a plurality of apertures 3 spaced by uniform distances from one another. The angled profiled member 2 has two closed faces formed by end walls 6 and 7. One of the end walls is provided with a slot, while the other of the end walls is provided with a peg 8. The adapter 1 is supported on the inner surfaces of the arms 4 and 5 of the angled profiled member 2.

As shown in FIG. 3, the adapter 1 has an aperture 9 which corresponds to the apertures 3 of the angled profiled member. A locking peg 10 of a component 11 to be attached to the angled profiled member can be inserted in the aperture 9. The component 11 is locked with the adapter 1 by the locking peg 10 upon turning of the component 11 through 90°. Thereby the adapter is reliably fixed to the angled profiled member 2.

The adapter 1 has two free external faces which are identified with reference numerals 12 and 13 and form attachment faces of the adapter. The attachment face 12 is provided with a slot 14, while the attachment face 13 is provided with an undercut tapering peg 15. The slot 14 also, has an undercut which is identified by broken lines. A further component to be attached has a peg with a tapering part which corresponds to the peg 15 and can engage the slot 14. Correspondingly, another component which has a slot corresponding to the slot 14 can engage the peg 15 of the adapter.

Additional components provided with locking pegs can be also attached to the apertures 3 of the angled profiled member 2. These locking pegs are shorter than the locking pegs 10 by the thickness of the wall of the adapter. While these locking pegs have to engage only through the apertures 3, the locking peg 10 has to engage through two apertures 3 and 9 which are located one behind the other.

As shown in FIG. 2 which is the cross-section along the line A-B of FIG. 1, the aperture 9 in the adapter has the same shape as the apertures 3 of the angled profiled member 2. Each of the apertures 3 is formed as an elongated slot with a widened recess 16 in its center. The recesses 16 correspond to the diameter of a rod-shaped part of the locking pegs to be inserted through the apertures.

As can be seen from FIG. 3 which shows the lateral face of the adapter 1 facing the component 11, the aperture 9 is arranged asymmetrically on the lateral face. More particularly it is arranged so that it aligns with the corresponding aperture 3 on the arm 5 of the angled profiled member 2.

As can be seen from FIG. 4, the underside of the adapter 1 which lies adjacent to the inner face of the arm 2 of the angled profiled member 2 has an opening corresponding to the inner hollow space of the adapter.

FIG. 5 shows a locking element which is identified with reference numeral 17. The locking element 17 has a locking peg 10 and an engagement surface 18. The locking element can be used in place of the component 11 to fix the adapter 1 to the angled profiled member 2. The locking peg 10 of the locking element 17 is inserted through the aperture 3 in the arm 5 of the angled profiled member 10 and then through the aperture 9 of the abutment and locked by being turned.

It should be noted that the free external sides of the adapter provided with the slot 14 and the peg 15 are in alignment with external longitudinal edges 19 and 20 of the arms 4 and 5 of the angled profiled member 2.

It will be understood that each of the elements described above, or two or more together, may also find a useful application in other types of constructions differing from the types described above.

While the invention has been illustrated and described as embodied in a toy construction kit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A toy construction kit, comprising an angled profiled member having two arms having identical width and arranged at a right angle relative to one another, each of said arms being provided with a plurality of apertures for engaging with locking pegs of adjoining components; a substantially block-shaped adapter arranged inside said angled profiled member between said arms and fixable to said angled profiled member, said adapter having a square cross-section so as to complete said angled profiled member to form a joint square cross-section, said adapter having free external sides provided with connecting means selected from a projection and a slot for connecting further components thereto, at least one side of said adapter being open; and means for fixing said adapter to said angled profiled member and including a locking peg which engages through a respective one of said apertures of said angled profiled member.

2. A toy construction kit as defined in claim 1, wherein said arms of said angled profiled member have longitudinal edges, said adapter having free edges which are in alignment with said longitudinal edges of said arms of said angled profiled member.

3. A toy construction kit as defined in claim 1, wherein said connecting means of said adapter includes at least one aperture.

4. A toy construction kit as defined in claim 1, wherein said connecting means of said adapter includes at least one peg.

5. A toy construction kit as defined in claim 1, wherein said connecting means of said adapter includes at least one slot.

6. A toy construction kit as defined in claim 1; and further comprising a component provided with said locking peg of said fixing means, said further component projecting at a right angle relative to said angled profiled member.

7. A toy construction kit as defined in claim 1, wherein said adapter has three further sides which are closed, two of said further sides being provided with said connecting means.

8. A toy construction kit as defined in claim 1, wherein said adapter has three further sides which are closed, one of said further sides being provided with an aperture which is in alignment with said respective aperture of said angled profiled member so that the locking peg of said fixing means after passing through said respective aperture of said angled profiled member can pass through said aperture of said adapter, the other two further closed sides of said adapter being provided with an undercut longitudinal slot and a tapering peg respectively to form said connecting means.

* * * * *